US009986876B2

(12) United States Patent
Brickl et al.

(10) Patent No.: US 9,986,876 B2
(45) Date of Patent: Jun. 5, 2018

(54) DISPENSER FOR SHEET PRODUCTS

(75) Inventors: Jeffrey J. Brickl, Lodi, WI (US); Edward A. Raleigh, Lodi, WI (US)

(73) Assignee: SCA HYGIENE PRODUCTS AB, Göteborg (SE)

( * ) Notice: Subject to any disclaimer, the term of this patent is extended or adjusted under 35 U.S.C. 154(b) by 0 days. days.

(21) Appl. No.: 14/425,936

(22) PCT Filed: Sep. 6, 2012

(86) PCT No.: PCT/EP2012/067403
§ 371 (c)(1),
(2), (4) Date: Mar. 4, 2015

(87) PCT Pub. No.: WO2014/037041
PCT Pub. Date: Mar. 13, 2014

(65) Prior Publication Data

US 2015/0265108 A1 Sep. 24, 2015

(51) Int. Cl.
*A47K 10/42* (2006.01)
*A47K 10/32* (2006.01)

(52) U.S. Cl.
CPC ..... *A47K 10/427* (2013.01); *A47K 10/422* (2013.01); *A47K 10/423* (2013.01); *A47K 2010/3233* (2013.01)

(58) Field of Classification Search
CPC ..... A47F 1/065
See application file for complete search history.

(56) References Cited

U.S. PATENT DOCUMENTS 1,901,243 A 3/1933 Horwitt
3,291,339 A 12/1966 Hein
(Continued)

FOREIGN PATENT DOCUMENTS

CN 1327427 A 12/2001
CN 2528370 Y 1/2003
(Continued)

OTHER PUBLICATIONS

English-language translation of a Chinese Office Action dated Sep. 26, 2016 issued in corresponding Chinese patent application No. 201280076539.4 (13 pages).
(Continued)

*Primary Examiner* — Gene O Crawford
*Assistant Examiner* — Ayodeji T Ojofeitimi
(74) *Attorney, Agent, or Firm* — Drinker Biddle & Reath LLP

(57) ABSTRACT

An in-counter or in-wall dispenser including a product housing and a cover is disclosed. The cover is pivotally mounted so as to pivot between an open position providing access to the interior volume defined by the product housing for loading a new stack of sheet products and a closed position so that the sheet products are only accessible through a dispensing opening in the cover for one at a time dispensing of sheet products from the product housing. First and second tab-like members project from an interior surface of the product housing into the interior volume. With the cover open, the first and second tab-like members engage in a margin or border area of a front face of the sheet products positioned closest to the dispensing opening to hold at least the engaged part of the sheet products spaced from an interior surface of the anterior cover.

29 Claims, 5 Drawing Sheets

(56) References Cited

U.S. PATENT DOCUMENTS

| | | | | |
|---|---|---|---|---|
| 4,094,442 | A | 6/1978 | Radek | |
| 4,234,101 | A * | 11/1980 | Pastore | A47F 1/065 221/241 |
| 5,222,628 | A * | 6/1993 | Roethel | A47F 1/085 221/307 |
| 5,632,409 | A | 5/1997 | Raghunanan | |
| 6,003,723 | A | 12/1999 | Morand | |
| 6,257,443 | B1 * | 7/2001 | LaCount | A47K 10/427 221/35 |
| 6,331,696 | B1 | 12/2001 | Nakamura et al. | |
| 6,354,462 | B1 * | 3/2002 | Conran | A47K 10/424 221/197 |
| 6,378,726 | B1 | 4/2002 | Chan et al. | |
| 6,655,544 | B1 | 12/2003 | Tanaka et al. | |
| 6,772,908 | B2 * | 8/2004 | Roethel | A47F 1/065 221/279 |
| 7,093,737 | B2 | 8/2006 | Tramontina et al. | |
| 7,124,911 | B2 * | 10/2006 | Tramontina | A47K 10/422 221/198 |
| 2003/0019880 | A1 | 1/2003 | Timmers et al. | |
| 2003/0146240 | A1 * | 8/2003 | Kawolics | G07F 11/04 221/307 |
| 2005/0056656 | A1 | 3/2005 | Hochtritt et al. | |
| 2006/0169712 | A1 * | 8/2006 | Yitzchaki | G07F 13/10 221/221 |
| 2006/0273102 | A1 | 12/2006 | Wieser et al. | |
| 2008/0142536 | A1 | 6/2008 | Cohen et al. | |
| 2009/0277920 | A1 | 11/2009 | Cittadino et al. | |

FOREIGN PATENT DOCUMENTS

| | | | |
|---|---|---|---|
| CN | 1593318 | A | 3/2005 |
| CN | 1767779 | A | 5/2006 |
| FR | 2551964 | A1 | 3/1985 |
| WO | WO-2004/093629 | A1 | 11/2004 |
| WO | WO-2005/107546 | A1 | 11/2005 |

OTHER PUBLICATIONS

Russian Decision of Grant dated Mar. 28, 2017 issued in corresponding Russian patent application No. 2015112313 (13 pages) and its English-language translation thereof (7 pages).

English-language translation of a Russian Office Action dated May 20, 2016 issued in corresponding Russian patent application No. 2015112313 (5 pages).

Second Chinese Office Action dated Apr. 19, 2017 issued in corresponding Chinese patent application No. 201280076539.4 (9 pages) and its English-language translation thereof (12 pages).

* cited by examiner

DISPENSER FOR SHEET PRODUCTS

CROSS-REFERENCE TO PRIOR APPLICATION

This application is a § 371 National Stage Application of PCT International Application No. PCT/EP2012/067403 filed Sep. 6, 2012, which is incorporated herein in its entirety.

TECHNICAL FIELD

The present disclosure is concerned with a dispenser for holding a stack of sheet products and for allowing individual sheet products to be dispensed from the stack. The dispenser includes a product housing defining an interior volume for accommodating the stack. The dispenser further includes a cover defining a dispensing opening through which individual sheet products may be dispensed from the dispenser. The present disclosure is particularly, but not exclusively, concerned with dispensers of an in-counter type in which a majority of the product housing is disposed behind a wall, and the cover and dispensing opening is provided in front of the wall so that a user can access the napkins.

BACKGROUND

There are a number of kinds of sheet product dispensers known in the art. For example, there are table top dispensers as described in US 2006/0273102 A1 that are designed to stand on a table top, counter top or other such horizontal surface and which have a dispensing opening facing upwardly. There are also dispensers designed to lay on a table top, counter top or other such horizontal surface in which the dispensing opening faces horizontally, such as disclosed in WO 2005/107546 A1. Additionally known are gravity feed dispensers, which, in contrast to the aforementioned spring biased dispensers, make use of gravity to feed sheet products to a dispensing opening. A gravity feed dispenser is known from US 2005/0056656 A1. The disclosed elements are applicable to all such dispensers, but are especially useful for in-counter dispensers.

An in-counter dispenser is one that does not stand on a counter top, table top or other such horizontal surface as with the previously mentioned dispensers, but instead is built into the counter top or table top or other such wall so that a major part of a product housing is hidden from view to the user, being positioned behind the wall. An in-counter dispenser has an advantage of freeing up counter space, and also being less conspicuous than dispensers that stand on the counter or table top.

An early design of an in-counter dispenser can be found in U.S. Pat. No. 1,901,243. In this disclosure, a dispenser is built into a table so that a front wall of the dispenser is substantially flush with a front wall of the table. A dispensing window is provided for allowing folded napkins to be readily removed. A pair of springs is provided for urging napkins toward a front of the dispenser. The springs push against a plate, which is positioned against a rear of the stack of napkins. The napkins are thus urged into the front wall of the dispenser to ensure that a napkin is available at the dispensing window for dispensing.

The springs in the prior art dispenser would, in practice, have been optimised so as to ensure that the stack of napkins is forced against the front wall of the dispenser for the whole range of napkin depletion states from a full dispenser to an empty dispenser, while at the same time ensuring that the spring is not overly powerful such that the napkins are pressed so forcefully against the front wall of the dispenser as to create too much friction against the uppermost napkin in the stack that is being dispensed. Such excessive friction can cause tearing of individual napkins and also cause accidental dispensing of a bunch of napkins, which is not desirable because of the associated waste of napkin material. Optimising a spring force of the spring so as to avoid bunching and tearing issues is not a straightforward process in the design of a dispenser. Further, even if an optimised spring force is achieved, if the dispenser is mounted to a vertical wall instead of a horizontal wall, which some customers do, then the spring force will be too great because the weight of the stack is no longer acting against the bias of the spring. In a dispenser built into a vertical wall, the weight of the stack lies on the product housing, and the spring force is used to bias the front of the stack against the front wall of the dispenser. The previously described tearing and bunching problems can thus occur.

While the tearing and bunching issues have been described above specifically with reference to an in-counter dispenser, the reader will appreciate that the same problems can occur in other types of dispensers, such as those identified above, wherein a spring or other force (e.g. gravity) causes a stack to be pressed with too much force against a front face of the dispenser causing excessive friction between a front napkin in the stack and the front face of the dispenser.

Accordingly, it is desired to provide a dispenser for dispensing sheet products that is able to reduce incidence of dispensing failure such as tearing or accidental bunching.

SUMMARY OF THE INVENTION

In a first aspect, there is provided a dispenser including:

- a front face including a dispensing opening, the dispensing opening for dispensing individual sheet products of a stack of sheet products;
- a product housing including at least one side wall extending from the front face, wherein an interior surface of the front face and an interior surface of the at least one side wall define, at least in part, an interior volume for receiving the stack;
- at least one hold back tab projecting from a side of the dispenser for engaging in a border of a front face of the stack and for holding the stack back from the interior surface of the front face of the dispenser.

The hold back tab keeps the front of the stack held back from an interior surface of the front face of the dispenser. This means that the front of the stack is not frictionally engaged with the interior surface of the front face. The frictional engagement with the at least one tab is relatively low. Accordingly, the front most napkin in the stack can be dispensed with a relatively low dispensing force, allowing the napkin to be smoothly withdrawn with reduced or eliminated risk of the napkin tearing. Further, since the stack of napkins is held back from the front face, the risk of the user accidentally grabbing a bunch of napkins is significantly reduced.

In an embodiment, the dispenser can be considered to have a central axis extending through the centre of each napkin in the stack (or through the centre of the interior volume) and through the front face (and optionally also the dispensing opening), wherein the at least one tab has opposed major surfaces extending along a plane perpendicular to the central axis. Put alternatively or additionally, the at least one tab has opposed major surfaces, and one of the major surfaces is arranged to engage along the border of the front of the stack. The described tab construction provides a low cost, high simplicity solution that securely engages at a border area of a front area of the stack. The at least one tab engages a front face of the stack, and not side faces of the stack where folds or other edges of the sheet products are positioned.

In an embodiment, the at least one tab includes first and second tabs that engage different portions of the border of the front area of the stack. In certain embodiments, the different portions are opposed portions. The use of two tabs provides greater hold back security. By locating the tabs opposite to one another, a degree of symmetry is provided so that the front area of the stack is arranged parallel to the interior surface of the front face of the dispenser. As described above, engaging the stack only at the border ensures a low friction solution.

The stack may include folded sheet products, where the folds are located so as to form opposed side faces of the stack. The stack may include opposed fold side faces where folds in the sheet products are located and opposed cut side faces where the stack is cut from a log of folded sheet products during manufacturing. In an embodiment, the at least one tab is arranged to engage in the border of the front face of the stack on at least one fold side. The side faces formed by the folds are dimensionally high precision relative to a 3 mm tolerance in the dimension between cut side faces. Thus, in certain embodiments, the at least one tab is arranged not to engage in the border at a cut side of the front area of the stack. Generally speaking, the stack forms a rectangular prism with the sheet products being stacked in the length direction and the side faces with the folds forming a width dimension of the prism greater than the height dimension formed by the cut side faces. The interior volume is correspondingly shaped. The at least one tab is thus arranged at a longer side of the interior volume, and may not be arranged at a shorter side of the interior volume, where longer sides of the interior volume correspond to the side faces with folds of the stack and the shorter sides of the interior volume correspond to the cut side faces of the stack.

The dispenser may have the stack received in the interior volume.

The at least one tab may project from an interior surface defining a side of the interior volume into the interior volume by a distance of at least 5 mm. The distance may be between 10 mm as a lower limit and 50 mm as an upper limit. The upper limit may be 40 mm, 30 mm, 20 mm or 15 mm. The projecting distance is a balance between ensuring that the front face of the stack is sufficiently grasped (which tends toward a greater projection distance) and reducing friction on the sheet product being dispensed (which tends toward a lower projection). The at least one tab may be arranged to overlie 1 mm or more, 2 mm or more, 3 mm or more, 4 mm or more or 5 mm or more of a border of a front face of the stack. The at least one tab may be arranged to overlie a maximum of 20 mm, 15 mm or 10 mm of a border of a front face of the stack.

The interior volume may be considered to have a z-axis extending through a centre of the napkins in the stack and through the front face of the dispenser and perpendicular to the x and y axis. The dimensions of the interior volume may be such that the y axis dimension thereof is greater than the x axis dimension thereof, as described alternatively above. The at least one tab may be arranged to protrude in the direction of the y axis by a percentage of the y dimension of the interior volume of 5% or more (e.g. if the y dimension is 120 mm, then the tab would protrude from an interior surface defining the interior volume into the interior volume by a distance of at least 6 mm) or 10% or more. An upper limit of the percentage extension may be 40% or less, 30% or less, 20% or less or 15% or less.

The at least one tab may be arranged to project along the y axis. The at least one tab may be arranged so as to be centrally located with respect to the x axis.

The one or more tabs should be located as close to the interior surface of the front face of the dispenser as possible so as not to reduce dispenser capacity and the ability for a user to conveniently grasp sheet products, while at the same time holding the front face of the stack back from the interior surface. The front face of the stack may even contact the interior surface of the front face of the dispenser, for example where a central portion of the stack away from the one or more tabs bulges frontwards. In this instance, the one or more hold back tabs have still performed their function described above, since pressure between the front of the stack and the interior surface is reduced by the one or more tabs. In one embodiment, the one or more tabs are located so that a rearward surface thereof is spaced within 2 cm of the interior surface along an axis parallel to the above described z-axis or parallel to an axis passing through the centre of the napkins in the stack and passing through the front face, where the parallel axis passes through the tab. The spacing may be within 15 mm or within 10 mm.

The at least one tab may project from the at least one sidewall of the product housing. That is, the at least one tab may be attached to the product housing and project into the interior volume relative to the at least one sidewall. In this way, if the front face is removable or otherwise able to be opened for reloading, the hold back tabs maintain the stack in position even with the front face removed. This significantly aids reloading.

In an embodiment, the dispenser includes a spring for urging the stack toward the front face of the dispenser. The at least one hold back tab ensures that the spring force is not, or is applied to a substantially reduced extent, between the front of the stack and the interior surface of the front face. In this way, dispensing failure as a result of tearing or bunching is avoided, by means that are fully functional irrespective of whether the dispenser is loaded with the spring force acting in a direction opposed to gravity, normal to gravity or some orientation therebetween. The dispenser may include a platform upon which a rear face of the stack sits (e.g. in direct contact). The spring may be positioned on the rearward side of the platform.

In one embodiment, the at least one tab is relatively thin so as not to take up stack capacity in the dispenser. For example, the at least one tab may have a thickness between opposed major surfaces of 3 mm or less or 2 mm or less or 1.5 mm or less or 1 mm or less. This feature also aids in achieving flexibility for the tab, as is discussed further below.

The at least one tab forms a projecting structure from a side of the dispenser so as to contact the front face of the stack from an edge of the front face of the stack and extending the contact into a border area of the front face of the stack.

In a second aspect, there is provided a dispenser, including:

- a product housing defining an interior volume for containing a stack of sheet products;
- a cover that is openable with respect to the product housing to reveal a loading opening for loading the product housing with a new stack of sheet products and that is able to be closed with respect to the product housing to close the loading opening;

structure for engaging a front face of the stack and for holding the stack of sheet products relative to the loading opening when the cover is opened, wherein the front face is the face of the stack that is revealed when the cover is opened.

Traditionally, when a loading cover of a dispenser is opened, the remaining sheet products of a remaining stack in the interior volume of the product housing can overflow relative to the loading opening. To prevent this, a maintenance person is required to perform a loading operation while holding the old stack of sheet products inside the product housing. The new stack is then inserted and is also held by the hand of the maintenance person until the cover is closed to keep the new stack of sheet products from overflowing from the loading opening.

The second aspect eases this maintenance operation. When the cover is opened, the remaining sheet products are held within the product housing to prevent overflow from the product housing. The new stack of sheet products can be inserted and this new stack will also be held relative to the loading opening by said structure, to allow the cover to be closed without the maintenance person having to hold the stack down by hand. Further, the structure of the second aspect will hold the stack back during use when the cover is closed, to achieve the advantages described above with respect to the first aspect.

Of course, the first and second aspects may be combined. Thus, the structure of the second aspect may be provided in the form of at least one hold back tab projecting from a side of the dispenser for engaging in a border of a front face of the stack and for holding the stack back from the interior surface of the cover of the dispenser. The cover may thus include the dispensing opening. The at least one hold back tab may be defined in any of the ways detailed above. Conversely, the at least one hold back tab of the first aspect may be provided so as to engage the front face of the stack and hold the stack of sheet products within the product housing when the front face of the dispenser is in an open position, wherein the front face of the dispenser is openable relative to the product housing to reveal the loading opening of the product housing for loading the product housing with a new stack of sheet products. The further features described below with respect to the second aspect are also applicable to the first aspect.

Thus, in the second aspect, the structure does not move with opening and closing of the cover.

In an embodiment, the cover includes a dispensing opening through which individual sheet products are dispensable when the cover is closed.

The loading opening is a mouth to the interior volume. It is usually defined by a frame, or at least part of a frame, that mates with the cover when the cover is closed and which extends about a front end of the interior volume. The structure may extend from the frame or adjacent to the frame.

The cover may be mounted to pivot between the opened and closed positions for ease of stack loading. Alternatively, the cover may form a detached component of the dispenser when the cover is opened.

The structure, like the at least one hold back tab discussed above, may space at least part of the front face of the stack from an interior surface of the cover when the cover is closed. In particular, the structure is spaced from the interior surface of the cover when the cover is closed, thereby holding at least the engaged part of the front face of the stack back from the interior surface of the cover. Some part of the front face of the stack may, however, bulge into contact with the interior surface of the cover, particularly in areas not engaged by the structure, but it will not do so with the pressure of prior art dispenser designs. Indeed, this bulging may even be desirable to promote ease of grasping of the front sheet in the stack through a dispensing opening in the cover.

The structure may be provided in the form of a projection from a part of the product housing defining an outer periphery of the interior volume, where the projection is into the interior volume. The projecting structure does not have to be in the form of one or more tabs (but preferably it is in this form), but may have the dimensions defined above, particularly with respect to extent of projection. The structure may be provided in the form of one or more flat members having opposed major surfaces. The thickness of the one or more members may be defined as above with respect to the one or more tabs embodiment.

In one embodiment, the structure is located within 20 mm, or 10 mm or 5 mm of the loading opening (which is the entrance opening to the interior volume). In this way, the capacity of the product housing is not reduced significantly and the front of the stack is kept reasonably close to the cover for ease of loading and, when the cover includes a dispensing opening, for ease of dispensing.

The structure may be configured to overlap an x-y plane of the interior volume, when a z-axis extends from a rear to a front of the dispenser through a centre of the sheet products in the stack (i.e. a cross-section of the dispenser extending perpendicular to the z axis), so as to contact a front face of the stack of sheet products, by an area of less than or equal to 30%, 25%, 20%, 15%, 10% or 5% of a total area of the interior volume of the x-y plane. This area ratio of stack contacting area to total area of a front face of the sheet products is applicable to the at least one tab described above and the at least one hold back member described below. The structure may be arranged to only contact a border area of the front face of the stack of sheet products.

In a third aspect, there is provided a dispenser including:

a product housing defining an interior volume for containing a stack of sheet products;

a front face including a dispensing opening through which individual sheet products of the stack are dispensable from the dispenser; and at least one hold back member for holding the stack back from an interior surface of the front face, wherein the at least one hold back member projects into the interior volume in a stack engaging configuration and wherein the at least one hold back member is positioned out of the way of the stack in a stack loading configuration, wherein the at least one hold back member is moveable between the stack engaging configuration and the stack loading configuration.

In the third aspect, the at least one hold back member may be positioned out of the way to load a stack in the product housing, and may be repositioned to engage the stack to hold the stack back from the cover for smoother dispensing.

In an embodiment, the stack engaging configuration includes a relatively large protrusion into the interior volume as compared to the stack loading configuration (in which there may be no protrusion into the interior volume at all).

In an embodiment, the at least one hold back member may be biased to return to the stack engaging configuration when in the stack loading configuration. This feature aids loading of the stack as the maintenance person is not required to carry out any steps to move or reconfigure the at least one hold back member after the stack has been loaded.

In an embodiment, a stack is passed over the at least one hold back member during stack loading, which causes the at least one hold back member to move from the stack engaging configuration to the stack loading configuration. The stack may hold the at least one hold back member in the stack loading configuration as the stack moves over the hold back member. In an embodiment, when the stack clears the hold back member, the at least one hold back member springs from the stack loading configuration to the stack engaging configuration.

In the various aspects disclosed above, a stack is loaded in the dispenser in a +z direction and, optionally, individual sheet products are dispensed in a −z direction at least one hold back member.

In an embodiment, the at least one hold back member is flexed into a collapsed configuration in the stack loading configuration. The collapsed configuration is to be understood with respect to the projecting state in the stack engaging configuration. The collapsed configuration may require the at least one hold back member to be flexed into a position pressed flat against an interior surface of the product housing as the stack is passed over the at least one hold back member. In the stack engaging configuration, the at least one hold back member projects into the interior volume relative to the interior surface, for example in a perpendicular orientation to the interior surface. A flexible material implementation offers an effective and relatively simple solution to a stack engaging member that can be moved between stack engaging and stack loading positions. The flexibility may be as a result of the thickness and material of the at least one hold back member. For example, a flat piece of polymer material may suffice.

In certain embodiments, the material for the at least one hold back member is sufficiently stiff as to not buckle under the force of any bias the stack has to move to the dispensing opening (e.g. by spring or gravity) and yet flexible enough to be collapsed into an out of the way position. Further, the material is resilient so as to move back to the stack engaging position after the stack has cleared the at least one hold back member.

In an embodiment, the at least one hold back member may have a bias such that it is easier to collapse in a direction of stack loading into the product housing than in the opposite direction. This can be achieved by a bend or curve in the hold back member or by a spring or other means for ensuring that the hold back member is only liable to collapse as intended, i.e. during stack loading. Alternatively, the housing may include a support surface on a front side of the at least one hold back member and a recess, hole, cutout or other space on a rear side of the at least one hold back member to make the at least one hold back member easier to move in a stack loading direction than the opposite direction when the at least one hold back member is in the stack engaging position.

In an embodiment, the dispenser includes a mouth opening through which the stack of sheet products is loaded into the interior volume, and the at least one hold back member is positioned at the mouth opening and projects interiorly from a periphery of the mouth opening in the stack engaging configuration. In this way, the at least one hold back member is suitably positioned at the top of the interior volume to ensure stack capacity is maintained and to ensure the sheet products are positioned suitably positioned adjacent the dispensing opening when being held back from the cover.

The dispenser of the third aspect can be combined with the features outlined with respect to the first and second aspects, and vice versa. So, the at least one hold back member may be provided in the form of at least one hold back tab projecting from a side of the dispenser for engaging in a border of a front face of the stack and for holding the stack back from the interior surface of the cover of the dispenser. Further, the at least one hold back member may be for engaging a front face of the stack and for holding the stack of sheet products back relative to a loading opening into the interior volume when the cover is opened, wherein the front face is the face of the stack that is revealed when the cover is opened, and wherein the cover is openable and closeable to allow access to the loading opening in the open position for stack loading and so that the loading opening can be closed for dispensing. Conversely, the at least one hold back tab of the first aspect may be positionable between stack engaging and stack loading configurations, wherein the at least one tab is out of the way of the stack in the loading configuration. Further, the structure of the second aspect can be able to move from a stack engaging configuration to a stack loading configuration, wherein the at least one tab is out of the way of the stack in the loading configuration. In fact, all features identified above with respect to each aspect are combineable independently and in groups, as will be clear from the following detailed embodiment, wherein all such features are combined in one implementation.

The aspects described above can be applied to an in-counter dispenser. However, it is imagined that they also could be applied to other types of dispensers, such as table top dispensers or countertop dispensers. A tabletop dispenser is one designed to sit on a horizontal surface by way of a base and has a dispensing opening oriented so that sheet product dispensing occurs in the vertical direction. A countertop dispenser is one that is designed to lay on a horizontal surface on a base and the dispensing opening is disposed so that dispensing of a sheet product occurs in the horizontal direction. Both countertop and tabletop dispensers differ from an in-counter dispenser in that they are designed to be positioned on a horizontal surface so that the entire housing can be seen, whereas an in-counter dispenser has a majority of the housing disposed behind, and thus, hidden from view by a horizontal or other wall surface.

In one embodiment, the in-counter dispenser includes a flange for seating against a cut-out in a wall. The product housing is sized to be positioned behind the wall, and passed through the cut-out in the wall during mounting. The wall may be a vertical wall, or a horizontal counter. The dispenser may include means for fixing the product housing relative to the wall. The flange may be fastened to the wall, for example.

The stack of sheet products may be a stack of napkins. The sheet products may be folded. The sheet products may be interfolded so that as one sheet product is fully dispensed and separated from the stack, the next sheet product in the stack is partly dispensed with it.

The dispenser may include a biasing device, such as a spring, for biasing the sheet products toward the dispensing opening or the hold back structure/tab/member. The dispenser may include a platform upon which the stack of sheet products lays. The platform may be subject to a bias to elevate the sheet products toward the dispensing opening or the hold back structure/tab/member. The stack of sheet products may thus be held compressed between the hold back structure/tab/member by the biasing device. The biasing device and platform are present in at least in-counter, tabletop and countertop dispensers.

BRIEF DESCRIPTION OF THE FIGURES

Embodiments of the invention will be described below with reference to the enclosed drawings, in which.

DETAILED DESCRIPTION OF PARTICULAR EMBODIMENTS

Figure 1:
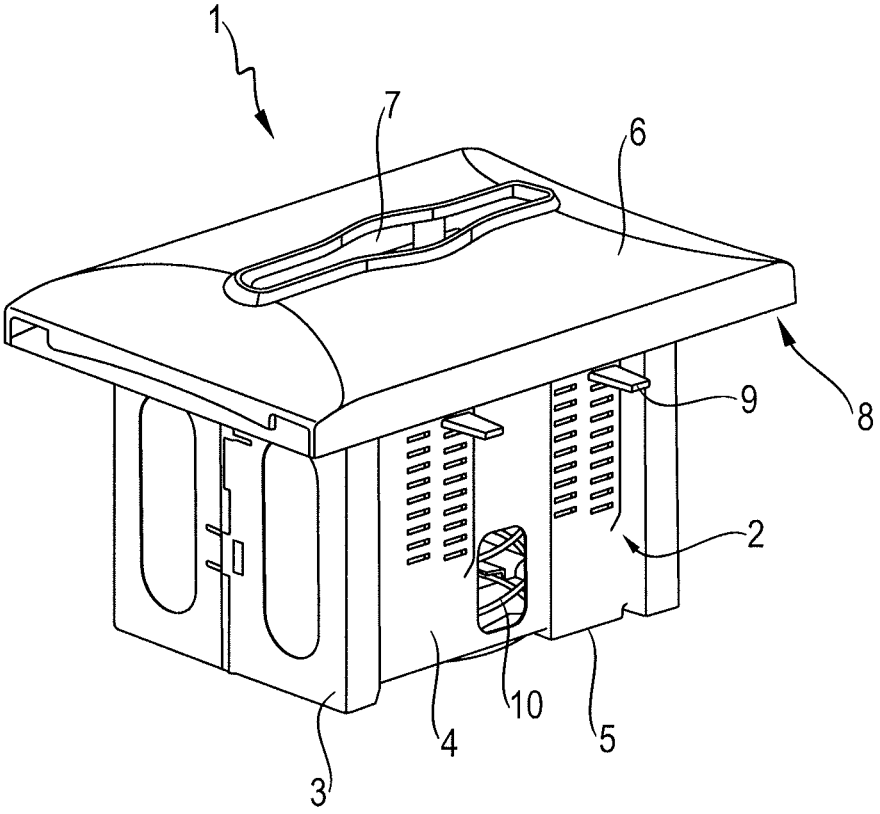
FIG. 1 shows a perspective view of a dispenser according to an embodiment of the invention.

FIG. 1 shows a dispenser design making use of the hold back means of the present invention. The hold back means itself cannot be seen in FIG. 1. The dispenser includes a product housing and a cover. The dispenser includes a flange at the front of the product housing so that the product housing passes through a cut-out in a wall, such as a countertop, for the flange to seat on a front surface of the wall. The cover is pivotally mounted so as to pivot between an open position providing access to the interior volume defined by the product housing for loading a new stack of sheet products and a closed position so that the sheet products are only accessible through a dispensing opening in the cover for one at a time dispensing of sheet products from the product housing.

Figure 2:
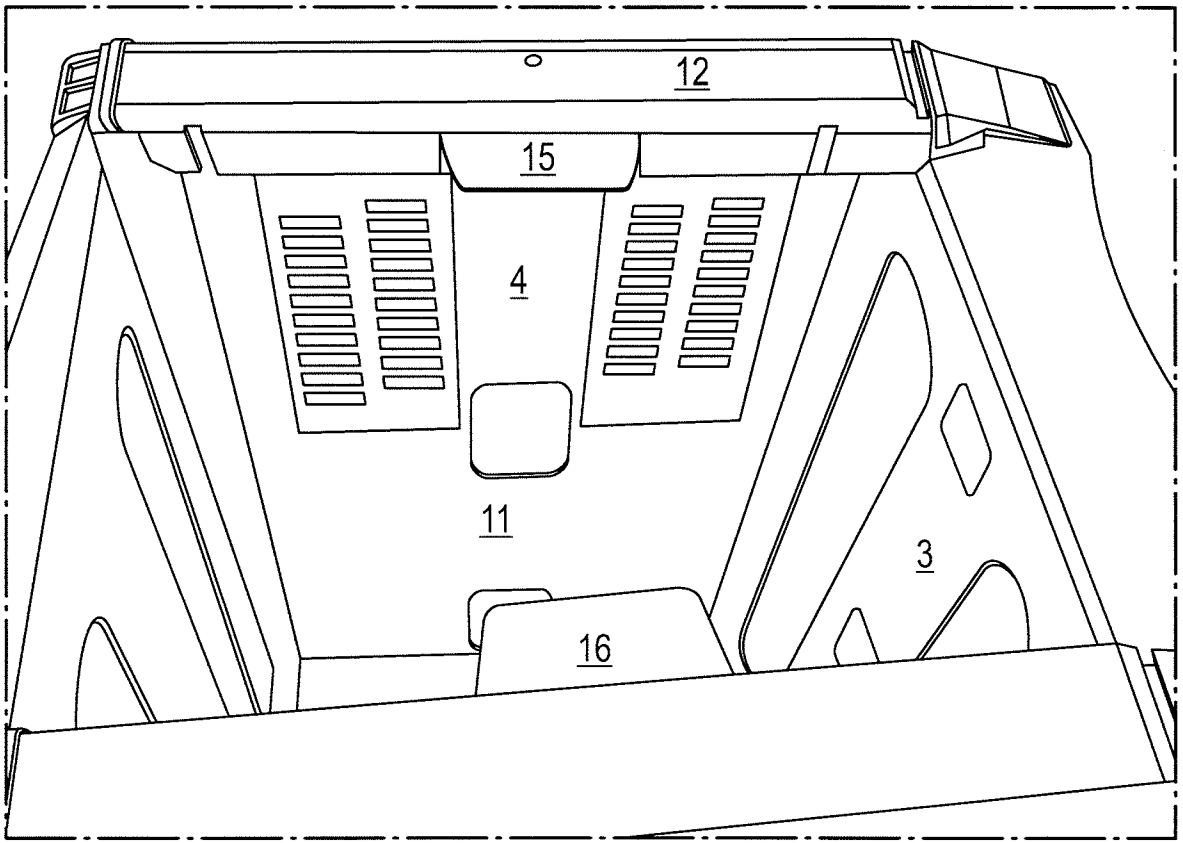
FIG. 2 shows a top view of the dispenser of FIG. 1 with the cover in the open position so that an interior volume of the product housing can be seen.

FIG. 2 shows the dispenser with the cover in an open position so that an interior volume of the product housing can be seen. Hold back means is provided in the form of first and second tab-like members projecting from an interior surface of the product housing into the interior volume, the interior volume being for accommodating a stack of sheet products. The first and second tab-like members engage in a margin or border area of a front face of the sheet products positioned closest to the dispensing opening to hold at least the engaged part of the sheet products spaced from an interior surface of the anterior cover. In the specific embodiment shown, a frame is provided to which the cover is pivotally attached. The first and second tab-like members are secured to the frame and project into an interior area defined by the frame. The first and second tab-like members are positioned on opposite long sides of a rectangular cross-section of the interior volume so as to engage opposite folded sides of the sheet products rather than cut sides.

Figure 3:
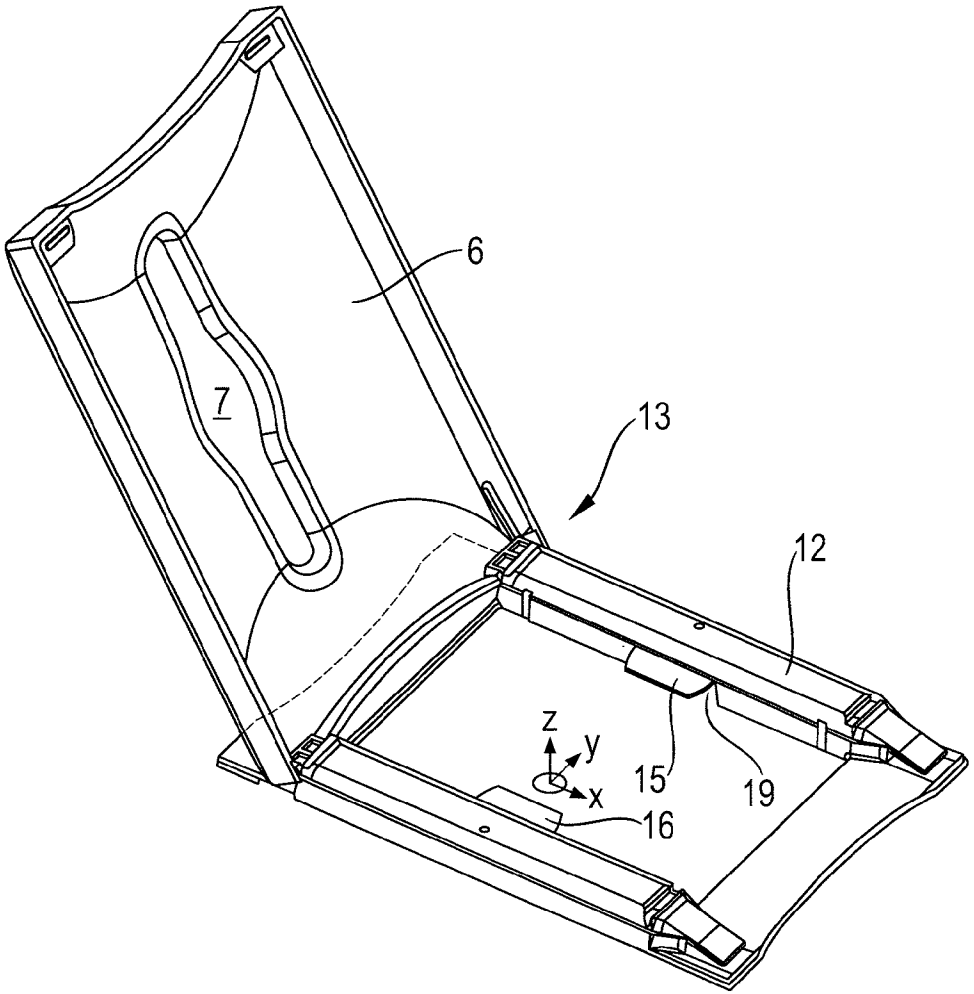
FIG. 3 shows a top view of a removable frame and cover portion of the dispenser of FIG. 1.

FIG. 3 shows a removable frame and cover portion of the dispenser, which is removably mountable to the product housing. This removability of the frame and cover is an optional feature of an embodiment of the present invention. It can be well envisaged that the hold back means of the present invention are applicable with more traditional sheet product dispensers. The frame has a depth in the stacking direction and is provided with cut-outs so that the tab-like members can be mounted in the cut-outs so as to project from the cut-outs in order that the tab-like members are mounted closer to the dispensing opening in the depth direction of the frame than if the cut-outs were not present and the tab-like members were mounted to a rear side of the frame.

FIG. 1 shows a dispenser 1 including a product housing 2 including four sidewalls 3, 4 and a base 5. The dispenser 1 also includes a cover 6 that includes a centrally located dispensing opening 7. The cover 6 may be pivoted relative to the product housing 2 between open and closed positions. In the view of FIG. 1, the cover 6 is in the closed position.

The dispenser 1 is an in-counter dispenser, which is provided with a flange 8 for seating on a front surface of a wall, such as a counter top, to which the dispenser 1 is mounted. When mounted, the flange 8 surrounds a cut-out in the wall. The product housing 2 is positioned through the cut-out and is disposed at least partly behind the wall. Thus, facing the front surface of the wall, the user only sees the cover 6 and the dispensing opening 7 of the dispenser, and does not see the hidden product housing 2. In order to secure the dispenser 1 to the wall, the dispenser 1 includes keys 9 that pass through a sidewall 4 of the product housing 2 to engage a rear surface of the wall. Such a key system for mounting the dispenser to a wall, such as a counter top, is merely exemplary as the exemplified tab-like hold back means is also applicable to more conventional dispensers, for example a dispenser in which a flange is screwed or otherwise fastened to the wall.

The dispenser 1 defines an interior volume 11 (partly shown in FIG. 2) for receiving a stack of sheet products such as napkins. In particular, the interior volume 11 is defined at least in part by interior surfaces of the cover 6, the sidewalls 3, 4 and the base 5. Disposed in the interior volume 11 is a spring 10 and a platform (not shown). The stack of sheet products is laid on the platform and the spring 10 biases the platform toward the dispensing opening 7. The platform is reciprocally movable within the interior volume in the rear to front direction, so as to be moveable away from and toward the dispensing opening 7.

In the particular dispenser 1 of FIG. 1, the cover 6 is pivotally mounted to a frame 12, as can be seen in FIG. 3. The frame 12 is removably mounted to the flange 8 at the top of the product housing 2 in a way that allows the frame 12 to pop off when the cover 6 is subjected to such a great pivoting force that there is a danger of a hinge mechanism 13 between the cover 6 and the frame 12 breaking. The removable frame 12 thus protects the hinge mechanism 13 from damage as a result of a user pivoting the cover 6 beyond a limit open position with too much force. This removable cover idea is merely exemplary as the tab-like members may be applied to more conventional dispensers of sheet products that do not have such a pop off frame 12 and cover 6.

The dispenser 1 further includes first and second tab-like members 15, 16, as can be clearly seen in FIGS. 2 and 3. The dispenser can be considered as having X, Y and Z axes as shown in FIG. 3. The Z axis extends through a centre of the base 5 of the product housing 2 and through a centre of the dispensing opening 7, and through a centre of the sheet products in the stack. The X and Y axes are perpendicular to the Z axis, where a short sidewall 3 of the product housing 2 extends along the Y axis and a long sidewall 3 of the product housing 2 extends along the Y axis. The first and second tab-like members 15, 16 extend in the XY plane. The first and second tab-like members 15, 16 project from an interior surface defining the interior volume 11 and project parallel to the Y axis into the interior volume. In the shown embodiment, the first and second tab-like members 15, 16 are secured to the frame 12 in a manner that will be described in further detail below with respect to FIGS. 4*a-c*.

Figure 4A:
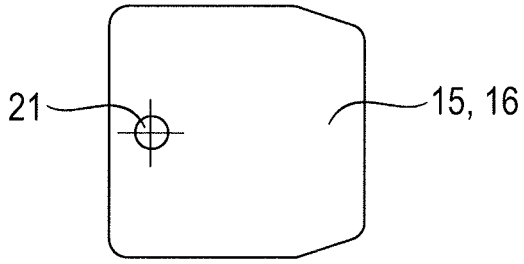
FIG. 4*a* shows a plan view of of a tab-like member separated from the dispenser of FIG. 1.
Figure 4B:
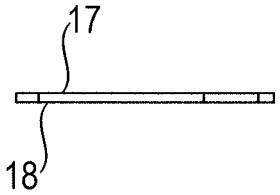
FIG. 4*b* shows a cross-sectional view of the tab-like member of FIG. 4*a;*

FIGS. 4*a* and 4*b* show different views of a tab-like member separated from the dispenser. The tab-like member is a flat piece of polymer material that includes a hole through the thickness of the tab-like member for mounting the tab-like member to the dispenser.

Figure 4C:
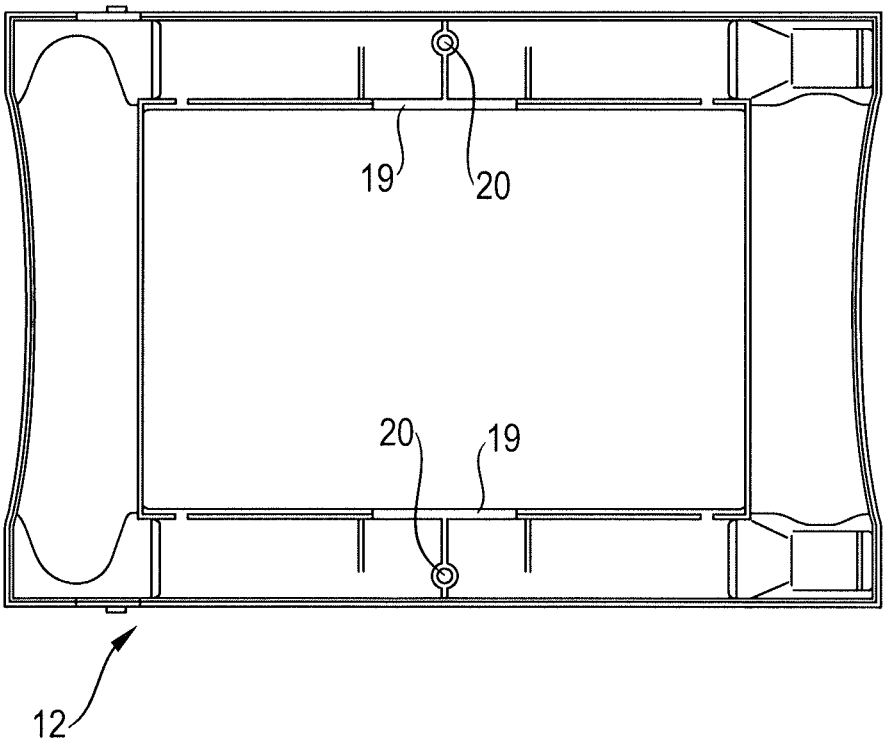
FIG. 4*c* shows a plan view of the frame portion of the dispenser of FIG. 1.

FIG. 4*c* shows a plan view of the frame portion of the dispenser to show the relative position of the cut-outs into which the tab-like members are placed and which also shows fastening holes in the frame. A fastener will be applied through the fastener hole of the tab-like members and through the fastening holes of the frame to mount the tab-like members to the dispenser. The tab-like members are provided in the form of thin pieces of flexible polymer material so that they can flex downwardly when a new stack of sheet products is pushed past them and so that they resiliently spring back into a more projecting position in order to engage on the front face of the new stack.

The first and second tab-like members are provided at a central location with respect to opposed sidewalls, particularly the long sidewalls 4, of the product housing 2 along the X axis. The first and second tab-like members 15, 16 project relative to an interior surface of the respective sidewall 4 into the interior volume in the Y direction by an amount of between 5 mm and 20 mm, or 10 mm and 15 mm. A greater projection distance will ensure that the front face of the stack of sheet products is engaged, but a smaller distance will reduce contact area providing a smoother dispensing function. The balance between these competing constraints in the dispenser of FIG. 1 has been settled at a projection of about 10 mm.

The first and second tab-like members 15, 16 are spaced from an interior surface of the cover 6, which provides a roof to the interior volume defined by the dispenser 1, and this spacing may be a distance of less than 10 mm and less than 5 mm. The spacing ensures that at least part of a front face of the stack is held back from the interior surface of the cover 6 to reduce or eliminate friction between the interior surface of the cover 6 and the front face of the stack. This is especially important in light of the spring force applied by the spring 10, tending to force the front face of the stack onto the interior surface of the cover 6. This pressure can be reduced or removed entirely by the first and second hold back tabs 15, 16. The first and second tab-like members 15, 16 also serve this function if dispenser 1 is mounted so that the spring force of the spring 10 applies horizontally, rather than vertically as is more often the case, when the pressure applied to the sheet products will be greater because the spring force is not counter acted by gravity. Accordingly, the dispenser 1 can be mounted horizontally or vertically, or any orientation therebetween, and smooth dispensing, resistant to tearing of the sheet products, can be secured.

The first and second tab-like members 15, 16 are sized to engage only in a margin area of a front face of the stack of sheet-like products so as to reduce the contact area. Further, the first and second tab-like members 15, 16 are tab-shaped, which ensures that they only extend to a limited extent along the margin, again ensuring a reduced contact area. The dimension of the first and second tab-like members along the margin or in the Y direction is between 10 mm and 100 mm, 20 mm and 90 mm, 30 mm and 80 mm, 30 mm and 70 mm, 30 mm and 60 mm, 30 mm and 50 or 35 mm and 45 mm. In a specific embodiment, the Y dimension of the first and second tab-like members 15, 16 is about 40 mm.

Referring now to FIGS. 4*a-b*, an embodiment of the first and second tab-like members 15, 16 can be seen. The first and second tab-like members 15, 16 are flat so as to have opposed major surfaces 17, 18. The first and second tab-like members 15, 16 include a fastening hole 21 for receipt of a fastener therethrough to mount the first and second tab-like members to the dispenser 1. The first and second tab-like members 15, 16 are flexible so as to bend in a desired direction, namely in a direction along the Z-axis that the stack is passed in order to load the dispenser 1. The flexibility comes from, at least in part, the nature of the material used to make the first and second tab-like members 15, 16, namely a polymeric material in the present case, and the thickness of the flat members 15, 16 between the opposed major surfaces 17, 18. In certain embodiments, the polymer material may be nylon 6/6 or any other material having similar inherent flexibility. The thickness of the material is less than 5 mm, 4 mm, 3 mm or 2 mm and, in a particular embodiment, is about 1 mm in thickness.

The frame 12 is provided with a cut-out 19 extending in the Z direction for receiving one of the first and second tab-like members 15, 16, as can be seen in FIGS. 3 and 4*c*. The cut-out 19 allows the frame 12 to support a front major surface 17 of the first and second tab-like members 15, 16, but the rear major surface 18 is not positioned against a corresponding support structure. The result is that the first and second tab-like members 15, 16 are more prone to flexing in the direction of loading a stack of sheet products along the +Z axis than in the opposite direction along the −Z axis. That is, the first and second tab-like members 15, 16 are more resistant to flexing in a direction along the Z axis toward the dispensing opening 7. This means that the first and second tab-like members 15, 16 flex easily so as to be less projecting when flexed in this direction by the loading of the stack, but resist flexing in the opposite direction so as to engage and hold back parts of the front face of the stack of sheet products.

The first and second tab-like members 15, 16 are positioned in opposed cut-outs 19 in the frame 12 and fasteners (not shown) are applied in respective fastener receiving holes 21 of the first and second tab-like members 15, 16 and respective fastener receiving holes 20 (FIG. 4*c*) in the frame 12.

In use, the dispenser 1 will be mounted to a wall, such as a vertical wall or a horizontal counter top, so that most of the product housing 2 is hidden behind the wall. The flange 8 will be seated on a front surface of the wall, while keys 9 will contact or be positioned adjacent to a rear surface of the wall so that a dispenser 1 is secured to the wall in the +Z and −Z direction. The cover 6 may be opened to reveal at least part of an interior volume for receiving a stack of sheet products. The optional frame 12 and the flange 8 surround a mouth opening to the interior volume through which the stack of sheet products are passed in the Z direction to load the dispenser 1 with a stack.

A rear face of the stack of sheet products will contact the first and second tab-like members 15, 16 as the stack of sheet products is passed into the interior volume and will flex the first and second tab-like members 15, 16 in a rearward direction so as to move the first and second tab-like members 15, 16 into an out of the way or less projecting position. The rear face of the stack will contact the platform (not shown) and the platform and the stack will be moved deeper into the product housing 2 against the bias of the spring 10. The first and second tab-like members 15, 16 will be held in the flexed, substantially non-projecting, position by side faces of the stack of sheets. The first and second tab-like members

15, 16 will only spring back into a projecting position, where this projecting position is shown in FIGS. 2 and 3, once a front face of the stack of sheet products has cleared a distal end of the first and second tab-like members 15, 16 (where the distal end should be understood as distal in the projecting direction along the Y axis).

The first and second tab-like members 15, 16, once in the projecting position, shown in FIGS. 2 and 3 will engage on opposed margins of a front face of the stack of sheet-like products, so that the stack of sheet-like products is held compressed between the first and second tab-like members 15, 16 and the platform, where the compression comes from the spring force of the spring 10. The cover 6 may be closed so that the sheet products in the stack can only be accessed through the dispensing opening 7. In the closed position shown in FIG. 1, an interior surface of the cover 6 is spaced from the front face of the stack of sheet products at least at the opposed margin portions contacting the first and second tab-like members 15, 16. The front face of the sheet products may bulge in a central region between the first and second tab-like members 15, 16 toward the dispensing opening 7, which will allow a front most individual sheet product in the stack to be conveniently grasped and withdrawn through the dispensing opening 7.

When an individual sheet product is withdrawn through the dispensing opening 7, it will be pulled from under one of the tab-like members 15, 16 and will then move from under the other of the tab-like members 15, 16 so as to be released from the product housing 2 and to allow the sheet product to be dispensed through the dispensing opening 7. In an interfolded sheet product stack, a subsequent sheet product will be pulled partly through the dispensing opening with the sheet product that has been entirely dispensed. In this way, part of a next front most sheet product in the stack will protrude through the dispensing opening 7 for convenient grasping by a user.

During dispensing, an individual sheet product is only forced by the spring 10 into contact with the tab-like first and second members 15, 16 at relatively small contact area portions, so that frictional force during withdrawal of the sheet product is relatively low, thereby providing resistance to tearing of the sheet product and securing a smooth dispensing operation. The front face of the stack of sheet products is, to a large extent, held back from an interior surface of the cover 6 so that the problems with pressure between the front face of the stack and the interior surface of the cover 6 in the prior art, causing tearing of sheet products that are dispensed, are avoided by the disclosed dispenser solution.

A number of alternative implementations for the stack hold back means of FIGS. 2 to 4*c* can be envisaged.

Figure 5:
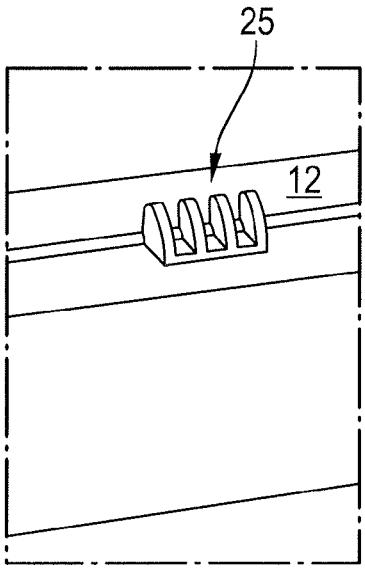
FIG. 5 shows a close-up view of an alternative tab-like member in a dispenser according to another embodiment of the invention.

FIG. 5 shows an alternative implementation of the tab-like members of the present invention in which a rigid tab-like member projects into the interior volume to engage a front face of a stack of sheet products. This embodiment serves as a useful hold back means, but loading of a new stack of sheet products into the product housing is not as convenient as with the flexible tabs of the embodiment of FIGS. 2 to 4*c*, because tab-like member of FIG. 5 is not able to move out of the way of the stack during stack loading.

FIG. 5 shows a tab-like hold back member that is fixed, which cannot be flexed, rotated, pivoted, reciprocated or otherwise moved out of the projecting position during stack loading. The tab member 25 of the alternative embodiment in FIG. 5 defines a ledge on a rear side that extends in the XY plane perpendicular to the Z axis and which has a ramped surface on a front side. The ledge surface provides an engagement surface for contacting a front face of a stack of sheet products to serve the hold back function. The ramped rear surface eases loading as it gradually forces a side face of the stack interiorly as the stack moves in the Z direction during loading.

The fixed tab-like member 25 of the alternative of FIG. 5 provides an implementation that is relatively straightforward to construct, but, even with the ramped rear surface, makes a loading operation more difficult for a maintenance person because of the extra force required to move the stack in the Z direction. The sheet products in the stack may also be slightly damaged during loading because the fixed tab member 25 does not have the ability to move out of the way, as with the flexible tab construction of the embodiment of FIGS. 2 to 4*c*. Nonetheless, the fixed tab member 25 does serve the hold back function, thereby providing the dispenser with resistance to sheet product tearing during dispensing as compared to if the fixed tab member 25 was not present and the front face of the stack of sheet products was being forced directly against an interior surface of the cover 6.

Figure 6:
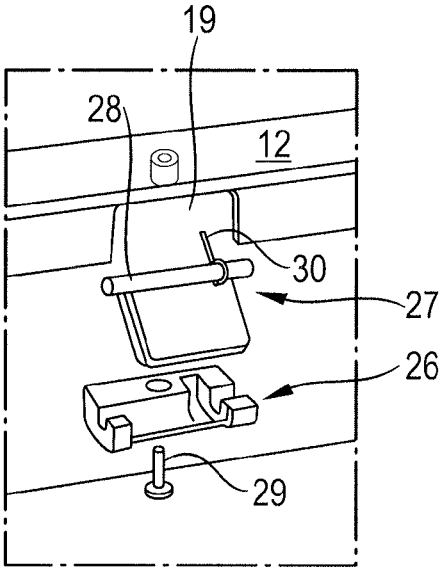
FIG. 6 shows a close-up view of yet another alternative tab-like member in a dispenser according to another embodiment of the invention.

FIG. 6 shows yet another alternative embodiment for the tab-like members in which the tab-like member is pivotally mounted to the dispenser, so that it rotates, rather than flexes, downwardly during loading of a stack of sheet products. A spring is provided to cause the tab-like member to move back into the projecting position to engage on a front face of the stack of sheet products once the stack of sheet products has moved clear of the tab-like member during loading. The tab-like member is configured so as to rotate downwardly from the projecting position, but to resist rotating upwardly so as to properly provide the hold back function.

In the alternative embodiment of FIG. 6, the tab-like member 27 is provided as a rotatable tab member. A cradle portion 26 is fixedly secured relative to the dispenser, particularly to the frame 12 by way of, in the shown embodiment, a fixing pin 29. The pivotable tab member 27 is rotatably mounted to the cradle by way of a rod 28 being rotatably received in the cradle portion 26. The tab member 27 is thus able to rotate into an out of the way position during stack loading, but does not rotate in the opposite direction from the projecting position because it is prevented from doing so by the frame 12 abutting the tab member 27 at the cut-out 19. As with the flexible tab implementation of the embodiments of FIGS. 2 to 4*c*, the rotatable tab member 27 is able to move downwardly from a projecting position as a result of contact of a rear face of new stack of sheet products during loading. Similarly to the embodiment of FIGS. 2 to 4*c*, the rotatable tab member 27 is able to spring back to the projecting position, by way of a torsion spring 30 in the shown embodiment. Further, the rotatable tab member 27 is able to rotate rearwardly so as to move out of the way of the stack of sheet products during loading, but resist movement toward the front of the dispenser so that the sheet products are held back from the interior surface of the cover 6 by the rotatable tab member 27 not rotating out of a projecting, stack engaging position.

The alternative embodiment of FIG. 6 offers equivalent functionality to the flexible tab of the embodiment of FIGS. 2 to 4*c* in terms of holding the front face of the stack of sheet products back from the interior surface of the cover 6 and in terms of moving out of the way of the stack of sheet products caused by movement of the stack of sheet products during loading. However, the cradle 26 and the spring 30 will increase the cost of manufacture in this alternative solution. It may, however, be advantageous as compared to the flexible tab solution in that the tab member 27 can be made more rigid, thereby allowing a more precise determination of the hold back position of the stack.

Figure 7:
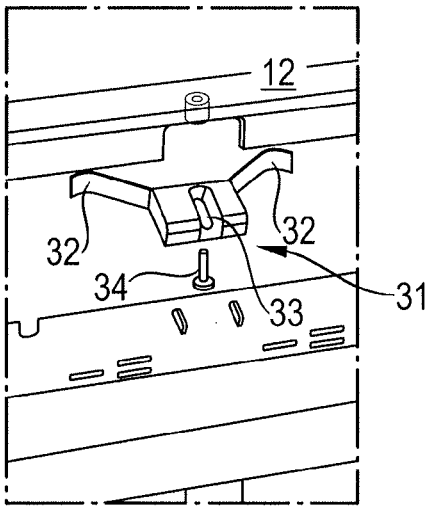
FIG. 7 shows a close-up view of yet another alternative tab-like member in a dispenser according to another embodiment of the invention.

FIG. 7 shows yet another alternative embodiment in which a tab-like member is associated with spring legs that splay apart in order to move the tab-like member into a less projecting position relative to the interior volume of the product housing for stack loading and which cause the tab-like member to spring back once the stack of sheet products is clear of the tab-like member to engage on the front face of the stack of sheet products.

In FIG. 7, a tab member 31 is not moved out of the way in the Z direction as with the flexible tab embodiment of FIGS. 2 to 4*c* and the rotatable tab embodiment of FIG. 6. Instead, the tab member 31 moves reciprocally in the XY plane, specifically parallel to the Y axis, between a retracted position (which is a position within the frame 12 in the particular embodiment shown) and a projecting position for engaging a front face of the stack of sheet products to hold the stack of sheet products back from an interior surface of the cover 6. In FIG. 7, the reciprocal tab member 31 is associated with spring legs 32 for biasing the tab member 31 into the projected position. The tab member 31 is secured in the Z direction, relative to the dispenser by a fastening pin 34. The reciprocal tab member 31 also includes a slot 33 that is oriented in the Y direction, which receives the fastening pin 34 therein, to guide reciprocal motion of the tab member 31.

The alternative embodiment of FIG. 7 provides a suitable hold back function, and also is able to be moved out of the way into a retracted position by spreading the spring legs 32 apart. In the embodiments of FIGS. 2 to 4*c* and the alternative embodiment of FIG. 6, clearance room must be provided in the Z direction for the flexible tab 15, 16 or the rotatable tab 27 to spring back from an out of the way position to a projecting position during stack loading. Although this clearance is relatively minor and can be provided simply by a slight compression of a full stack of napkins, there will be a very small limitation on the size of the stack in the Z direction that can be fit into the dispenser as a result of this clearance requirement. The embodiment of FIG. 7 does not suffer from this disadvantage as the reciprocal tab member 31 only moves in the XY plane. However, the flexible tab embodiment of FIGS. 2 to 4*c* and the rotatable tab embodiment of FIG. 6 has the advantage that they move out of the way in the direction of loading of the stack, which means that the stack more automatically, and without requiring any further input by a maintenance person, moves the tab member into a stack loading position purely by contacting the stack and moving with the stack.

Other, non-illustrated alternative embodiments can be envisaged by the skilled person. In the embodiment of FIGS. 2 to 4*c*, there is a plurality of hold back members 15, 16. It can be imagined that just one hold back member could be provided to contact on one side of a front face of the stack. Alternatively, instead of first and second tab-like members 15, 16, three, four, five, six, etc. or more hold members could be provided, distributed along just first and second sidewalls 4 for engaging folded sides of the stack of sheet products and not cut sides, or a plurality of holdback members could be distributed so as to be provided on three or more sides of a front face of the stack. It can also be imagined that a continuous member could be provided for engaging a margin area of a front face of a stack of sheet products, suitably dimensioned so that the contact area is reduced as compared to when, as in the prior art, the whole front face of the stack of sheet products is pressed against an interior surface of the cover 6.

In the embodiment of FIGS. 2-4*c*, the hold back members are provided as projecting tabs that have a generally rectangular shape when viewed in plan, along the Z direction. One can imagine semicircle, triangle, square and other shapes for the projecting tab members when viewed in plan. It can also be imagined that the first and second tab-like members 15, 16 are provided so as to project relative to the short sidewalls 3, rather than the long sidewalls 4, although this would generally involve engaging on a cut side of a front face of the stack of sheet products, which does not, generally, have as tight manufacturing tolerances as the folded sides.

In the various alternative embodiments presented herein, the hold back structure can engage a margin area of a front face of the sheet products, is able to contact a front face of a stack of sheet products irrespective of an opening and closing state of the cover, and is able to move between a loading configuration in which the structure is less projecting and a projecting configuration for engaging on a front face of the stack of sheet products when the stack is loaded. These three aspects can be independently implemented to achieve advantages described herein, or implemented in any combination to achieve a synergy in the combination of advantages.

The invention claimed is:

1. A dispenser, comprising:

a front face including a dispensing opening having a longitudinal extent and a transverse extent, which is equal to or shorter than the longitudinal extent, the dispensing opening for dispensing individual sheet products of a stack of sheet products;

a product housing including at least one side wall, wherein an interior surface of the front face and an interior surface of the at least one side wall define, at least in part, an interior volume for receiving the stack; and at least one hold back tab projecting from and removably attached to a side of the dispenser in a direction perpendicular to the longitudinal extent for engaging a border of a front face of the stack and for holding the stack back from the interior surface of the front face of the dispenser, wherein the dispenser has a central axis extending through the center of each sheet product in the stack and through the front face of the dispenser, wherein the at least one hold back tab has opposed major surfaces extending along a plane perpendicular to the central axis, and wherein one of the major surfaces is arranged to engage along the border of the front of the stack.

2. The dispenser of claim 1, wherein the at least one tab comprises first and second tabs that engage different portions of the border of the front area of the stack.

3. The dispenser of claim 2, wherein the different portions are opposed portions of the front face of the stack.

4. The dispenser of claim 1, wherein the dispenser defines the interior volume as a rectangular prism having rear and front faces and four side faces extending therebetween, wherein there are two opposed longer side faces and two opposed shorter side faces, wherein the at least one tab is arranged at a longer side face of the interior volume, and wherein longer sides of the interior volume correspond to stack side faces with folds and the shorter sides of the interior volume correspond to stack cut side faces.

5. The dispenser of claim 1, wherein the at least one tab projects into the interior volume by a distance of at least 5 mm.

6. The dispenser of claim 1, wherein the interior volume has a z-axis extending through a centre of the sheet products in the stack and through the front face of the dispenser and perpendicular to an x and y axis, wherein the at least one tab is arranged to protrude in the direction of the x or y axis by a percentage of the x or y dimension of the interior volume by 5% to 40%.

7. The dispenser of claim 1, wherein the interior volume has a z-axis extending through a centre of the sheet products in the stack and through the front face of the dispenser and perpendicular to a x and y axis, wherein the dimensions of the interior volume are such that the y axis dimension thereof is greater than the x axis dimension thereof, wherein the at least one tab is arranged to project along the y axis or an axis parallel to the y axis, and additionally or alternatively the at least one tab is arranged so as to be centrally located in the interior volume with respect to the x axis.

8. The dispenser of claim 1, wherein the at least one tab is located so that a rearward surface thereof for engaging the front face of the stack is spaced within 2 cm of the interior surface of the front face of the dispenser along an axis passing through the sheet products in the stack and passing through the front face, wherein the parallel axis passes through the tab.

9. The dispenser of claim 1, wherein the at least one tab comprises opposed major surfaces including a front surface and a rear surface for engaging a front face of the stack, wherein the front surface is spaced from an interior surface of the front face of the dispenser along an axis passing through the sheet products in the stack and passing through the front face, wherein the parallel axis passes through the tab.

10. The dispenser of claim 1, wherein the at least one tab includes a fixed end fixed to the side of the dispenser and a free end projecting into the interior volume for engaging the front face of the stack.

11. The dispenser of claim 1, wherein the at least one tab is attached to a sidewall of the product housing and project into the interior volume relative to the at least one sidewall.

12. The dispenser of claim 1, further comprising a spring for urging the stack toward the front face of the dispenser.

13. The dispenser of claim 1, wherein the at least one tab has a thickness between opposed major surfaces of 3 mm or less.

14. A dispenser, comprising:

a product housing defining an interior volume for containing a stack of sheet products;

a cover that is openable with respect to the product housing to reveal a loading opening through which a stack of sheet products enters the housing for loading the product housing with a new stack of sheet products, the cover being able to be closed with respect to the product housing to close the loading opening; and at least one tab projecting from and removably attached to a part of the product housing defining an outer periphery of the interior volume, where the projection is into the interior volume for engaging a front face of the stack and for holding the stack of sheet products in the product housing relative to the loading opening when the cover is opened and for holding the stack of sheet products a distance from the cover such that the front face does not contact the cover when the cover is closed, wherein the front face is the face of the stack that is revealed when the cover is opened.

15. The dispenser of claim 14, wherein the at least one tab does not move with opening and closing of the cover.

16. The dispenser of claim 14, wherein the cover includes a dispensing opening through which individual sheet products are dispensable when the cover is closed.

17. The dispenser of claim 14, wherein the loading opening is defined by a frame, or at least part of a frame, that mates with the cover when the cover is closed and which extends about a front end of the interior volume.

18. The dispenser of claim 14, wherein the cover is mounted to pivot between the opened and closed positions.

19. The dispenser of claim 14, wherein the at least one tab is provided in the form of one or more flat members having opposed major surfaces, a rear one of the opposed major surfaces for engaging a front face of the stack.

20. The dispenser of claim 14, wherein the at least one tab is located between 5 and 20 mm of the loading opening, wherein the loading opening is the entrance opening to the interior volume for stack loading.

21. The dispenser of claim 14, further comprising a spring for biasing the stack of sheet products toward the cover, wherein the stack is held compressed in the product housing between the at least one tab and the spring when the cover is opened.

22. A dispenser, comprising:

a product housing defining an interior volume for containing a stack of sheet products;

a front face including a dispensing opening through which individual sheet products of the stack are dispensable from the dispenser; and at least one hold back member for holding the stack back from an interior surface of the front face, wherein the at least one hold back member projects into the interior volume in a stack engaging configuration and wherein the at least one hold back member is positioned out of the way of the stack in a stack loading configuration, wherein the at least one hold back member is moveable between the stack engaging configuration and the stack loading configuration, wherein the at least one hold back member is arranged so that when a stack is passed over the at least one hold back member during stack loading, the at least one hold back member is caused to move from the stack engaging configuration to the stack loading configuration.

23. The dispenser of claim 22, wherein the stack engaging configuration requires a relatively large protrusion into the interior volume as compared to the stack loading configuration.

24. The dispenser of claim 22, wherein the at least one hold back member is biased to return to the stack engaging configuration when in the stack loading configuration.

25. The dispenser of claim 22, wherein the at least one hold back member is disposed so that when the stack clears the hold back member, the at least one hold back member springs from the stack loading configuration to the stack engaging configuration.

26. The dispenser of claim 22, wherein the at least one hold back member includes a fixed end and a free end, wherein the free end is rotatable relative to the fixed end from the stack engaging configuration to the stack loading configuration.

27. The dispenser of claim 22, wherein the at least one hold back member is flexed into a collapsed configuration in the stack loading configuration.

28. The dispenser of claim 22, wherein the at least one hold back member is pressed relatively flat against or extends relatively parallel to an interior surface of the product housing in the stack loading configuration, and wherein the at least one hold back member projects into the interior volume relative to the interior surface in the stack engaging configuration.

29. The dispenser of claim 22, wherein the dispenser comprises a mouth opening through which the stack of sheet products is loaded into the interior volume, and the at least one hold back member is positioned at the mouth opening and projects interiorly from a periphery of the mouth opening in the stack engaging configuration.

* * * * *